United States Patent [19]

Duhon

[11] Patent Number: 4,489,780

[45] Date of Patent: Dec. 25, 1984

[54] WELLHEAD LUBRICATOR

[76] Inventor: Gus A. Duhon, Rte. 3, Box 252 GD, Lafayette, La. 70503

[21] Appl. No.: 529,561

[22] Filed: Sep. 6, 1983

[51] Int. Cl.[3] ..... E21B 23/00

[52] U.S. Cl. ..... 166/70; 166/85; 137/875

[58] Field of Search ..... 166/70, 75 R, 775, 79, 166/85, 92, 93, 94; 137/875

[56] References Cited

U.S. PATENT DOCUMENTS

| | | | |
|---|---|---|---|
| 3,472,317 | 10/1969 | Fowler | 137/875 X |
| 3,773,062 | 11/1973 | McIver | 137/875 X |
| 3,924,686 | 12/1975 | Arnold | 166/85 X |
| 4,252,149 | 2/1981 | Dollison | 166/70 X |

*Primary Examiner*—James A. Leppink
*Assistant Examiner*—Thuy M. Bui
*Attorney, Agent, or Firm*—Bode & Smith

[57] ABSTRACT

A wellhead lubricator comprising a housing arranged for vertically extending attachment to a wellhead assembly and having a wireline for supporting a wireline tool therein and passing the wireline tool in and out of the well to the point of attachment to the wellhead; a laterally extending portion of the housing forming a part of the chamber of the housing; a longitudinally extending portion extending from the laterally extending portion and having an opening for passage of a wireline tool therethrough while the housing remains attached to the wellhead; a cap for closing the tool opening; a guide supported in the housing and shiftable between a first position for guiding the wireline tool in and out of the well through the point of attachment to the wellhead and a second position for guiding the wireline tool to the longitudinally extending portion; a spring-actuated valve member for urging the guide to the second position for guiding the wireline tool to the longitudinally extending portion; and a fluid-actuated valve member for urging the guide to the first position for guiding the wireline tool in and out of said well at the point of attachment to the wellhead.

16 Claims, 5 Drawing Figures

WELLHEAD LUBRICATOR

BACKGROUND OF THE INVENTION

1. Field of the Invention

The apparatus of the present invention relates to "wellhead lubricators" a term of art used in the oil and gas industry to describe a tool that is normally mounted on the top of a wellhead or "Christmas Tree" (another term of art in the industry) to house a wireline tool while the shutoff and/or master valve of the wellhead assembly are either opened to lower tools into the well under pressure or closed to prevent accidental falling of the wireline tool into the well during "make-up" or withdrawal. The lubricator acts as a pressure housing to allow a straight opening to the downhole tubing or to house a wireline tool during well shut-in. More particularly, the lubricator of the present invention provides a diverter means for guiding a wireline tool housed in the lubricator into a lubricator extension wherein all necessary tool "make-up" or changing can be done.

2. Description of the Prior Art

Prior standard lubricators are generally of a straight tube configuration and must ordinarily be disconnected from the wellhead in order to extract the wireline tool therefrom or to insert or "make-up" a different wireline tool therein prior to running the wireline back "down hole." Such prior art devices are illustrated in the following U.S. patents:

U.S. Pat. No. 2,755,863 issued to H. N. Stansbury, et al; and U.S. Pat. No. 2,710,064 issued to F. N. Osmun.

This design of a lubricator requires several operators and extensive time and thus expense as the entire lubricator has to be uncoupled and removed from the wellhead on every running or "trip" of the wireline tool or for sequentially checking or changing wireline tools or adding additional wireline tools.

U.S. Pat. No. 3,924,686 issued to J. F. Arnold attempted to solve the aforementioned problems by adding to the lubricator housing a laterally extending portion having a second tool opening for passage of the wireline tool therethrough while the housing remained attached to the wellhead and a guide means for guiding the wireline tool to the second opening when the tool is to be removed from the housing. While this structure allows for both passing the wireline tool into and out of the well through the point of attachment to the wellhead and passing the wireline tool through the second opening by providing laterally extending portion (30) of lubricator housing (12) and thus a single enlarged housing (11) which allows the wireline tool to shift to the position of FIG. 2 under the force of the diverter arm (35), the wireline tool can shift from this preferred lateral position at an angle relative to the vertical position in laterally extending portion (30) to the vertical position when diverter arm (35) resumes the position of FIG. 1 thus recreating the undesirable vertical positioning of the wireline tool for potentially falling down hole with the only remedy being time-consuming and expensive "fishing" operations to retrieve the tool. Further, Arnold's diverter arm (35) is fully manually operable from the positions of FIG. 1 and FIG. 2 and does not automatically assume a position of blocking the wireline tool from falling downhole.

U.S. Pat. No. 4,252,149 issued to W. W. Dollison and discloses a tool diverter for guiding flowline tools into selected flowpaths. The diverter member (13) closes the main flow line to allow a tool string to move therethrough. Diverter member (13) is pivoted by rotation of operating shaft (14), one end of which has a square cross-section engaged in a blind opening (15) in the diverter member (13). Shaft (14) is slidable axially within opening (15).

3. Summary of the Invention

It is therefore an object of the apparatus of the present invention to provide a wellhead lubricator having a lubricator extension with a tool opening for passage of a wireline tool therethrough and out of the well at deck or floor level.

It is a further object of the present invention to provide a wellhead lubricator having a lubricator extension connected to but independent of the wellhead pipe string.

It is a further object of the present invention to provide a wellhead lubricator with means positioned under bias of spring action for guiding or diverting the wireline tool into the lubricator extension to prevent the tool from falling downhole.

It is a further object of the present invention to provide guide or diverter means with fluid pressure activated means for selectively positioning the diverter to pass the wireline tool in and out of the well through the point of attachment to the wellhead.

The apparatus of the present invention provides a wellhead lubricator having a housing for vertically extending attachment to a wellhead assembly and a wireline for supporting a wireline tool therein and passing the wireline tool in and out of the well through the point of attachment to the wellhead, a portion extending laterally from the housing and forming a chamber therewith, a portion extending longitudinally from the lateral extending portion and connected therewith and having an opening at its bottom for passage of the wireline tool therethrough, a cap with bleed valve for closing the opening, and a guide or diverter in the housing positioned under the bias of spring action for guiding the wireline tool into the longitudinally extending portion but movable under fluid pressure to a second position for guiding the wireline tool in and out of the well through the point of attachment to the wellhead.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and, wherein.

DETAILED DESCRIPTION OF THE PREFERRED EMBODIMENT

Figure 1:
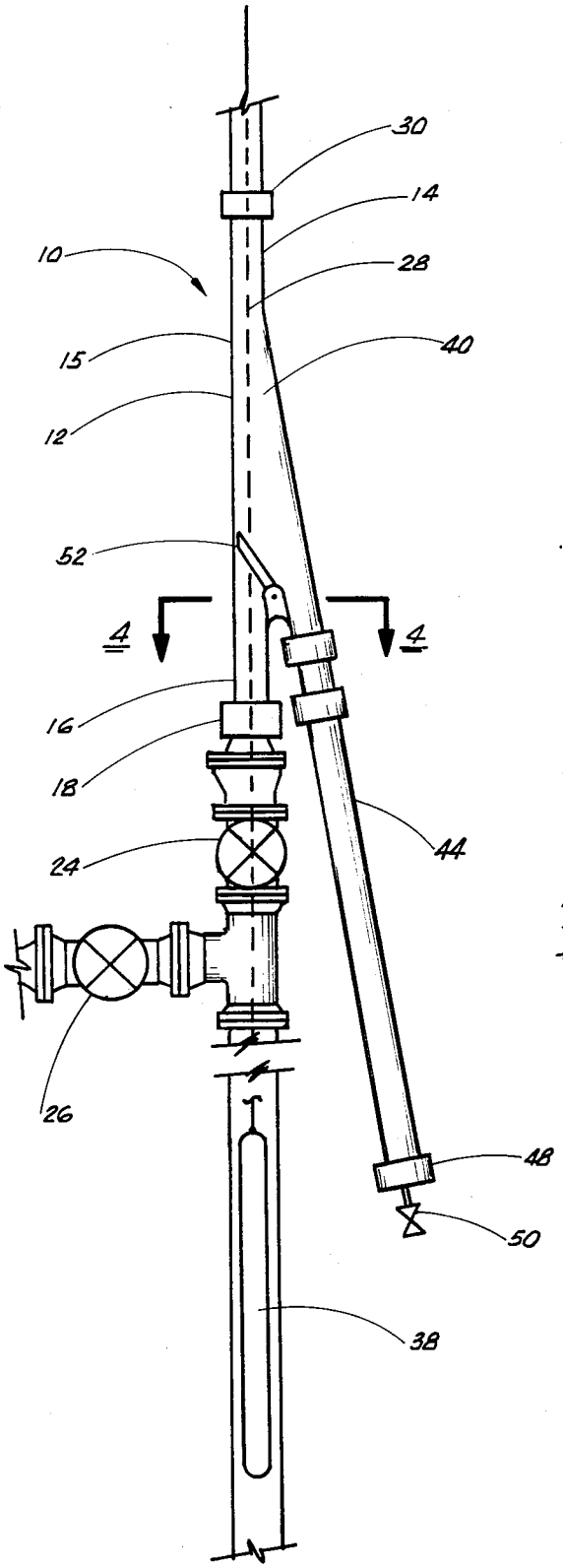
FIG. 1 is a side elevational view, partly in cross-section, of the apparatus of the present invention mounted atop a conventional wellhead and having a wireline tool "down hole".

Referring now to the drawing, the wellhead lubricator of the present invention is generally designated by the numeral 10. Lubricator 10 includes a lubricator housing 12 which is shown extending vertically upward from and attached to a conventional wellhead or "Christmas Tree" 20 by means of a conventional adapter 22. Housing 12 is comprised of an upper vertical pipe string section 14 and lower vertical pipe string section 16 having pipe string section 15 therebetween with laterally extending section 40 which extends laterally a greater distance near the lower pipe string section 16 than near the upper pipe string section 14.

Wellhead or "Christmas Tree" 20 includes, among other things, a master valve 24 for shutting off flow through the wellhead and a wing valve 26 for controlling the flow of fluids from wellhead 20. Housing 12 is adapted to receive thereinto in conventional fashion a wireline 28, which is shown in FIGS. 1 and 2 as passing vertically through housing 12, through conventional "stuffing box" 30 and thence exterior of housing 12 and then to a conventional power drum (not shown) for "take-up" and "pay-out" as required.

Wireline 28 has supported thereon a conventional wireline tool 38 which of course can take many different forms and the one illustrated is merely for that purpose. Wireline tool 38 is arranged for lowering in the well through wellhead 20, i.e., through the point of attachment of housing 12 to wellhead 20, by means of wireline 28.

Housing 12 has a laterally extending portion 40 which, as discussed above, extends laterally a greater distance near lower pipe string section 16 than near upper pipe string section 14 of lubricator housing 12. Laterally extending portion 40 is disposed at an angle relative to the vertical although preferably less than 45°. Laterally extending portion 40 extends laterally its greatest distance at point 45 where it is fixedly connected to and communicates with one end of upper lubricator extension portion 42 by means of joint 46. Upper lubricator extension portion 42 is fixedly connected to and communicates with, at its other end, lower lubricator extension section 44 by means of another joint 47. Lower lubricator extension portion 44 is elongated and considerably more than upper lubricator extension portion 42 and of sufficient length to accept wireline tool 38 as shown in phantom view in FIG. 2. Lower lubricator extension section 44 is provided at its lower end with a plug or cap 48 having an internal conduit therethrough connected to a bleed valve 50 which when closed effectively seals the pressurized chamber formed by wellhead lubricator 10. Cap 48 is of sufficient diameter to admit passage of wireline tool 38 through the opening provided in housing 12 when cap 48 is removed. As best seen in FIG. 2, were cap 48 to be removed as mentioned above, wireline tool 38 could be raised and lowered through lubricator extensions 42, 44 and the opening in housing 12 created by the removal of cap 48 by operation of wireline 28 by either taking up or letting out the same.

Figure 2:
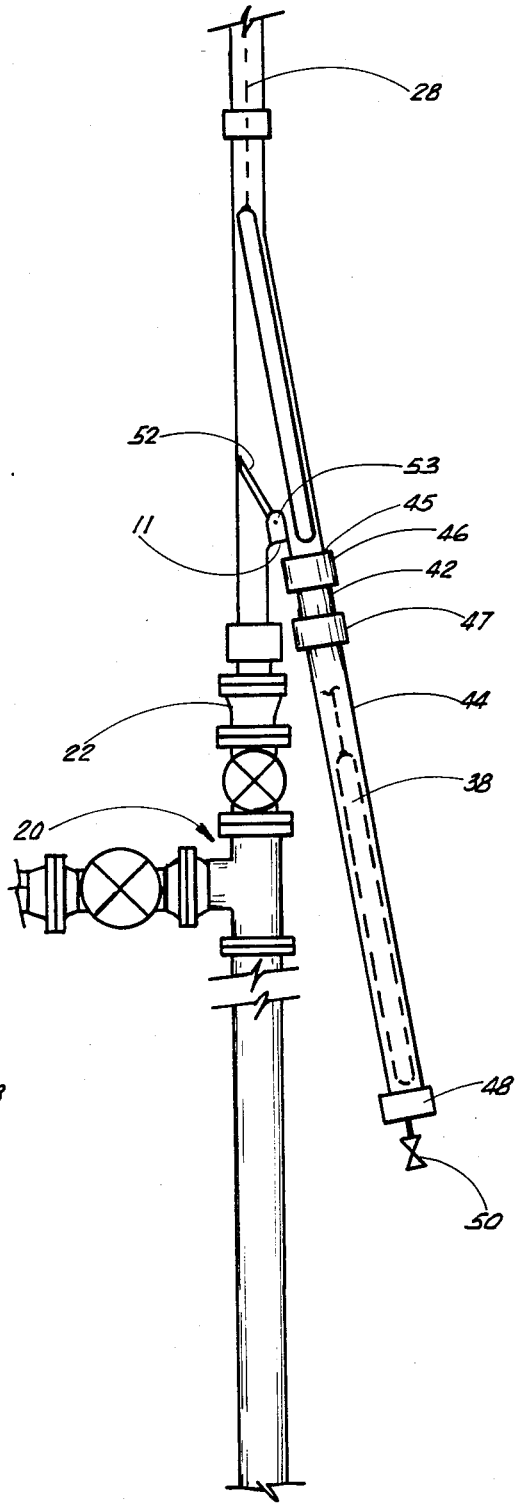
FIG. 2 is a view of the apparatus of FIG. 1, however, having the wireline tool supported in the lubricator extension.

As best seen in FIGS. 1 and 2, lubricator 10 of the present invention includes a diverter or guide means 52 supported in housing 12 for guiding wireline tool 38 to the opening created by the removal of cap 48, when the tool is to be removed from housing 12 as shown in FIG. 2.

Figure 4:
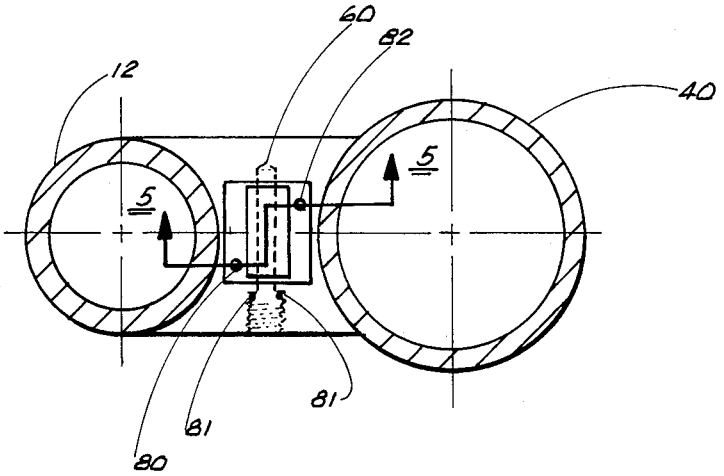
FIG. 4 is a cross-sectional view taken along line 4—4 of FIG. 1.
Figure 3:
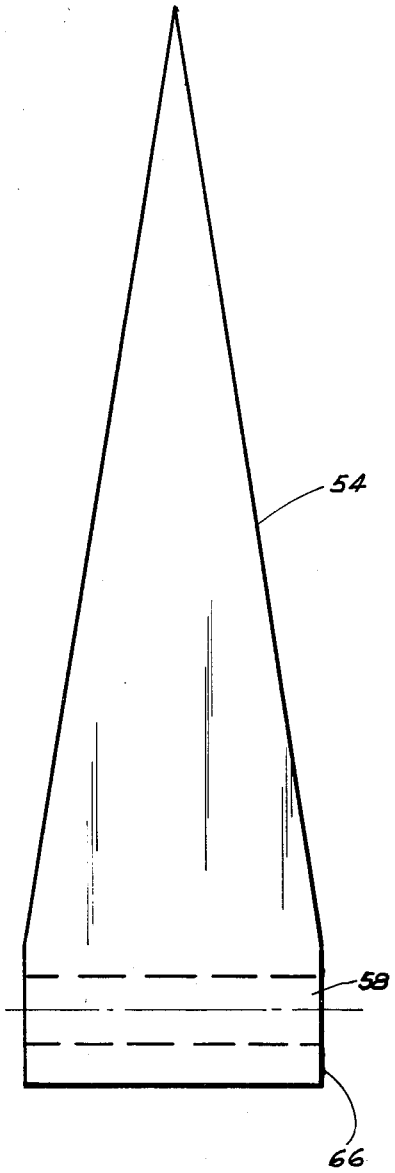
FIG. 3 is an elevational view of the diverter or guide means of the apparatus of the present invention.
Figure 5:
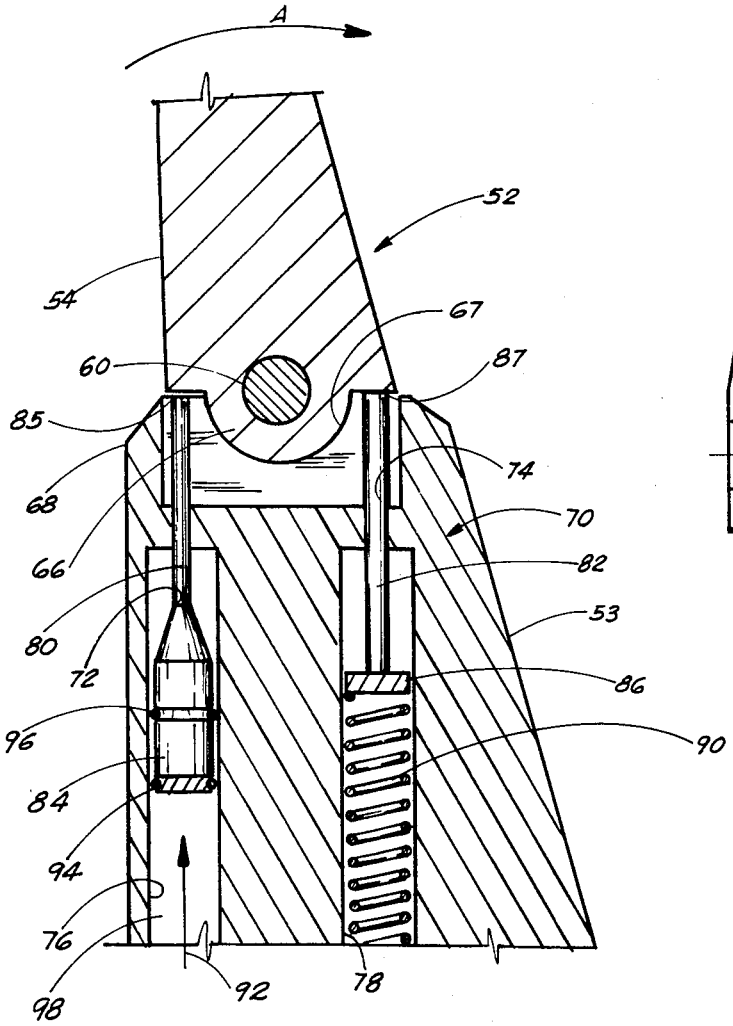
FIG. 5 is a partial sectional view taken along line 5—5 of FIG. 4 showing the details of construction of the control means of the diverter.

As best seen in FIGS. 3–5, diverter 52 is comprised of substantially triangular-shaped arm 54 provided with transverse bore 58 near the base thereof. The lower surface of arm 54 has depending therefrom convex base portion 66 for mating with transverse groove or notch 67 provided in the upper portion 68 of body 53. Pin 60 which is rotatably, threadably and sealingly extended through body 53 (mounted on saddle 11 of lubricator 10 formed at the union of the uppermost portion of lower vertical pipe string section 16 and laterally extending portion 40) and bore 58 thus allowing for rotational or pivotal movement of arm 54 in housing 12. O-rings 81 provide the sealing means in mounting pin 60 in body 53. Arm 54 is further dimensioned for contacting wireline tool 38 when the same is supported in housing 12 by wireline 28 and arranged for diverting wireline tool 38 laterally into laterally extending portion 40 of housing 12 and lower lubricator section 44, as best shown in FIG. 2. Arm 54 of diverter 52 is triangular-shaped in the preferred embodiment to allow wireline 28 to pass by it in housing 12 when wireline tool 38 is in the down hole position of FIG. 1; but divert wireline tool 38 to upper lubricator extension 42 and/or lower lubricator extension 44 for removal, make-up, etc., as shown in FIG. 2.

Diverter 52 is arranged for remote operation from a point exterior of housing 12 and this conveniently takes the form of control means 70, best shown in FIG. 5. Control means 70 selectively controls the movement of arm 54 of diverter 52 between the blocking position of FIGS. 1 and 2 which diverts wireline tool 38 into laterally extending portion 40 and/or lower lubricator section 44 and the vertical or "open hole" position of FIG. 5 which allows wireline tool 38 to be lowered and raised in and out of the well through wellhead 24. Control means 70 provides, as best seen in FIG. 5, for a pair of longitudinal bores 72, 74 extending the length of body 53. Bores 72, 74 are further provided with lower enlarged bore portions 76, 78. Bores 72, 74 have mounted therein slide valves 80, 82 respectively having pistons 84, 86 provided at the lower end thereof. The upper ends of side valves 80, 82, can extend through bores 72, 74 respectively and exteriorly of body 53 at its upper portion 68 and engage lower surfaces 85, 87 of arm 54 thus controlling its position.

Control means 70 is further provided, as best seen in FIG. 5, with means for maintaining arm 54 in the blocking position of FIGS. 1 and 2 comprising a compression spring 90 mounted in enlarged bore section 78 with one end abutting the lower surface of piston 86 and the other abutting the base of bore 78. Spring 90 urges piston 86 and thus slide valve member 82 upwardly into engagement with surface 87 thus pivoting arm 54 to the position of FIG. 1 and maintaining arm 54 in that same position until rotation of arm 54 in the direction of Arrow A to the "open hole" position is desired.

Control means 70 further provides for, as best seen in FIG. 5, means to selectively urge arm 54 of diverter 52 to the "open hole" position of FIG. 5 comprising port 92 communicating with bore 76 for exposing the lower surface of piston 84 to a source of fluid pressure (not shown). Piston 84 has in annular groove therearound for receiving and mounting O-ring 94 for sealing in bore 76. Piston 84 also has at its midpoint a second annular groove therearound for receiving and mounting O-ring 96 for also sealing in bore 76. When sufficient fluid pressure is provided bore 76 through port 92, piston 84 and thus slide valve 80 are urged upwardly into engagement with surface 85 thus pivoting arm 54 and diverter 52 in the direction of Arrow A to the position of FIG. 5 and maintaining arm 54 in this same position until rotation of arm 54 opposite the direction of Arrow A to the blocking position of FIG. 1 is desired. O-rings 94 and 96 effectively seal the chamber 98 created by bore 76 and the lower most surface of piston 84 to prevent fluid leakage of the pressure provided through port 92. Also, it precludes high pressure from housing 12 from passing through bore 72 and creating back pressure through port 92.

In operation, control means 70 would maintain diverter 52 in the blocking position of FIG. 1 by the absence of fluid pressure through port 92 thus enabling spring 90 to urge valve member 82 upwardly into continuous engagement with surface 87. If rotation of diverter 52 to the "open hole" position of FIG. 5 were desired a predetermined high pressure would be introduced into bore 76 through port 92 to act against the lower surface of piston 84 and move piston 84 and thus valve member 80 upwardly into engagement with surface 85 and rotate arm 54 in direction of Arrow A to the position of FIG. 5. The predetermined high pressure would thus provide a force upon the lower surface of 84 to overcome the force of spring 90 thus allowing rotation of arm 54 in the direction of Arrow A.

In operation, when it is desired to run one or more wireline tools into the well on which wellhead 20 is mounted, lubricator housing 12 is mounted in a manner shown in FIGS. 1 and 2 with a housing extending generally vertically upward therefrom. Master valve 24 and wing valve 26 would normally be closed with the well shut-in thereby containing the pressure present in such well. With pressure bled off through bleed valve 50 and with cap 48 removed, the attaching end of wireline 28 is lowered through the opening formed by the removal of cap 48 and is attached to a wireline tool such as wireline tool 38. Thereafter, by taking in on wireline 28, wireline tool 38 is drawn upwardly into lubricator housing 12 created by the removal of cap 48. With the wireline tool 38 completely enclosing within housing 12, cap 48 is reinserted in the manner shown in FIG. 1 with bleed valve 50 closed. Thereafter, master valve 24 of the wellhead 20 is opened and fluid pressure is provided at port 92 to expose piston 84 to the same thus moving piston 84 and valve member 80 upwardly and acting against surface 85 of arm 54 thus rotating arm 54 in the direction of Arrow A and to the position of FIG. 5 and allowing wireline tool 38 to be lowered into the well in conventional fashion by lowering on wireline 28.

When the operation of the wireline tool in the well is to be terminated, wireline tool 38 is raised to the raised position in housing 12 and master valve 24 thereafter closed. As wireline tool 38 is raised, diverter or guide means 52 is again forced under fluid pressure acting on piston 84 to the substantially vertical position of FIG. 5 to allow passage of the wireline tool 38 upwardly past it. Once wireline tool 38 has been raised to a level above guide means 52, fluid pressure at port 92 is eliminated and spring 90 will bias valve stem 82 against surface 87 and rotate arm 54 opposite the direction of Arrow A to its blocking or angulated position best shown in FIGS. 1 and 2. Pressure inside housing 12 is then bled off through bleed valve 50 and when that operation is completed, then threaded cap 48 is removed. By the maintaining of arm 54 in the blocking position of FIGS. 1 and 2, wireline tool 38 is removed from housing 12 by lowering on wireline 28 such that wireline tool 38 is caused to pass outwardly through upper lubricator section 42, lower extending lubricator section 44 (wireline tool 38 shown in phantom view) and through the opening created by the removal of cap 48.

At this point another or different wireline tool may be attached to wireline 28 and the operational sequence repeated. It will be observed that this tool permits the use of several wireline tools or the repeated use of one wireline tool without the necessity for removing housing 12 from wellhead 20 as is required with conventional lubricators. As a result, this invention provides a tool which can be operated with a minimum of time to run in succession a plurality of wireline tools without the necessity for removing and reinstalling a lubricator housing with each tool. Further, wireline tool 38 is prevented from shifting from the laterally extending portion 40 to the vertical section 12 as guide means 52 is constantly biased to the blocking position absent fluid pressure applied to the lower surface of piston 84.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A wellhead lubricator comprising:

a. a housing arranged for vertically extending attachment to a wellhead assembly and having a wireline for supporting a wireline tool therein and passing said wireline tool in and out of said well through the point of attachment to said wellhead;

b. a first portion extending laterally from said housing and normally forming a part of the chamber in said housing;

c. a second portion extending longitudinally from said laterally extending portion and connected thereto and having an opening for passage of a wireline tool therethrough while said housing remains attached to said wellhead;

d. means for closing said tool opening;

e. means supported in said housing and movable between a first position for guiding said wireline tool in and out of said well through the point of attachment to said wellhead and a second position for guiding said wireline tool to said longitudinally extending portion; and f. means for selectively controlling the movement of said guide means between said first and second positions, comprising:

i. a spring urging said guide means to said second position; and ii. means activated by wellhead fluid pressure for selectively urging said guide means to said first position.

2. The apparatus of claim 1 wherein said laterally extending portion extends a greater distance near its lower end than at its upper end.

3. The apparatus of claim 2 wherein said second portion extends longitudinally from said first extending portion at an angle relative to the vertical.

4. The apparatus of claim 1 wherein said opening is located near the bottom of said longitudinally extending portion whereby a wireline tool may be raised or lowered into and out of said lubricator through said opening by use of said wireline.

5. The apparatus of claim 1 further comprising means for selectively bleeding pressure from said lubricator.

6. A wellhead lubricator comprising:

a. a housing arranged for vertically extending attachment to a wellhead assembly and having a wireline for supporting a wireline tool therein and passing said wireline tool in and out of said well through the point of attachment to said wellhead;

b. a first portion extending laterally from said housing and normally forming a part of the chamber of said housing;

c. a second portion extending longitudinally from said laterally extending portion and connected thereto and having an opening for passage of a wireline tool therethrough while said housing remains attached to said wellhead;

d. means for sealably closing said tool opening;

e. means supported in said housing and movable between a first position for guiding said wireline tool in and out of said well through the point of attachment to said wellhead and a second position for guiding said wireline tool to said longitudinally extending portion; and f. means for controlling the movement of said guide means between said first and second positions further comprising:

i. means for normally urging said guide means to said second position; and ii. wellhead fluid pressure activated means for selectively urging said guide means to said first position.

7. The apparatus of claim 6 wherein said laterally extending portion extends a greater distance near its lower end than the upper end.

8. The apparatus of claim 7 wherein said second portion extends longitudinally from said laterally extending portion at an angle relative to the vertical.

9. The apparatus of claim 6 wherein said opening is located near the bottom of the longitudinally extending portion, whereby a wireline tool may be raised or lowered into and out of said lubricator through said opening by using said wireline.

10. The apparatus of claim 6 wherein said means for urging said guide member to said second position further comprises a spring.

11. The apparatus of claim 6 further comprising a valve for selectively bleeding pressure from said lubricator.

12. A wellhead lubricator comprising:

a. a housing arranged for vertically extending attachment to a wellhead assembly and having a wireline for supporting a wireline tool therein and passing said wireline tool in and out of said well through the point of attachment to said wellhead;

b. a first portion extending laterally from said housing and extending a greater distance near the bottom than the top, said portion normally forming a part of the chamber in said housing;

c. a second portion extending longitudinally from said laterally extending portion and connected thereto and having an opening for passage of a wireline tool therethrough while said housing remains attached to said wellhead;

d. means for closing said tool opening;

e. means supported in said housing and movable between a first position for guiding said wireline tool in and out of said well through the point of attachment to said wellhead and a second position for guiding said wireline tool to said longitudinally extending portion; and f. means for controlling the movement of said guide means between said first and second positions further comprising:

i. means for normally urging said guide means to said second position; and ii. fluid pressure activated means for selectively urging said guide means to said first position, said fluid pressure being supplied by normal wellhead pressure upon opening of the master valve.

13. The apparatus of claim 12 wherein said opening is located near the bottom of the longitudinally extending portion, whereby said wireline tool may be raised or lowered into and out of said lubricator through said opening by use of said wireline.

14. The apparatus of claim 12 further comprising a valve for selectively bleeding pressure from said lubricator.

15. The apparatus of claim 12 wherein said means for urging said guide means to the second position further comprises:

a. an elongated body having a bore extending longitudinally thereof;

b. a slide valve mounted within said bore for longitudinal movement;

c. said slide valve having a piston on one end and means at the other end for engaging said guide means; and d. a spring urging said slide valve into engagement with said guide means.

16. The apparatus of claim 12 wherein said means for selectively urging said guide means to said first position further comprises:

a. an elongated body having a bore extending logitudinally thereof;

b. a slide valve mounted within said bore for longitudinal movement;

c. said slide valve having a piston at one end and means at the other end for engaging said guide means;

d. a source of fluid under pressure; and e. port means providing said fluid in communication with said bore and exposing the outer face of said piston to fluid pressure for moving said slide valve into engagement with said guide means.

* * * * *